United States Patent [19]

Daniels, Jr.

[11] 3,945,346

[45] Mar. 23, 1976

[54] ROTARY DIESEL ENGINE

[76] Inventor: Phillip S. Daniels, Jr., 5231 Seven Hills Road, Pfafftown, N.C. 27040

[22] Filed: Mar. 10, 1975

[21] Appl. No.: 556,631

[52] U.S. Cl. ..... 123/8.47; 123/8.11; 418/191; 418/104

[51] Int. Cl.[2] ..... F02B 55/14

[58] Field of Search ..... 123/8.47, 8.11, 8.25, 8.43; 418/191, 241, 138, 104, 108

[56] References Cited

UNITED STATES PATENTS

| | | | |
|---|---|---|---|
| 858,912 | 7/1907 | Rousseau | 123/8.47 X |
| 1,240,112 | 9/1917 | Winger | 123/8.47 |
| 2,215,096 | 9/1940 | Fanberg | 123/8.47 X |
| 3,237,613 | 3/1966 | Mosovsky | 418/191 X |
| 3,323,499 | 6/1967 | Gljbeis | 123/8.11 |
| 3,401,676 | 9/1968 | Wanzenberg | 418/191 X |
| 3,765,378 | 10/1973 | Waldrum | 123/8.47 X |

*Primary Examiner*—Clarence R. Gordon

[57] ABSTRACT

A rotary diesel engine comprising a casing which forms a working space composed of intersecting cylindrical chambers. A rotor is rotatably positioned in at least one of the chambers and a rotary sealing member is positioned at least in one of the other of the chambers, the rotor having a plurality of radially extending lobes and the rotary sealing member having a plurality of radially extending grooves intermeshing with the lobes. A fuel injection assembly is cooperatively carried by the rotary sealing member and is made up of a manifold, a fuel entry port, fuel injection chambers, and pressure building and metering components for each of the fuel injection chambers. An appropriate actuating device, stationarily located external to the rotary sealing member, provides control for the complete fuel injection assembly.

15 Claims, 10 Drawing Figures

ROTARY DIESEL ENGINE

BACKGROUND, BRIEF SUMMARY, AND OBJECTIVES OF THE PRESENT INVENTION

This invention relates to rotary internal combustion engines and more specifically to a diesel rotary engine having specific rotor and sealing members designed to operate at maximum efficiency.

Rotary engines have been known in the art for a considerable period of time. Representative versions of such devices are fully disclosed schematically and operationally in U.S. Pat. Nos. 3,117,562; 3,237,613; and 3,777,723. The principles of the present type of rotary engine to the extent they are set forth in those references are incorporated herein by reference.

Although numerous designs of rotary engines have been known for some time, they have not experienced widespread use presumably because of combustion chamber size limitations, inadequate sealing elements, and imperfect fuel injection assemblies. It has also been extremely difficult to maintain temperatures and compression ratios needed at various locations throughout such rotary devices to achieve maximum operating efficiencies, particularly in diesel environments.

The present invention is designed to overcome these difficulties by including within its structure adequate combustion chamber spacing, a positive sealing mechanism for each chamber, adequate compression ratios, and a reliable fuel injection assembly. The present invention, while applicable to gasoline engines, is more particularly appropriate for diesel engine construction because of the ability to withstand extremely high pressures within the internal engine structure that is needed when diesel fuel is injected to mix with highly compressed air for combustion.

It is therefore an objective of this invention to provide a basic rotary engine with a pair of rotating elements which mesh in a straight-radial-line to achieve positive-piston displacement within naturally formed compression and combustion chambers.

Another object of the present invention is to provide a rotary engine particularly suitable for diesel application because of its ability to withstand the high internal pressures experienced when fuel is injected to mix with compressed air for combustion.

A further object of the present invention is to provide a rotary engine of the type described which has a radially slidable sealing assembly in each cylinder forming groove of the rotary sealing member.

Still another object of the present invention is to provide a rotary engine of the type described having a fuel injection assembly which includes a manifold supplying individual fuel injection chambers each of which are selectively actuated by appropriate means.

Yet still another further object of the present invention is to provide a compression chamber that will create a fierce turbulence within the combustion chamber required for proper mixing of fuel and air and enable efficient burning of gases.

Yet another further object of the present invention is to provide a rotary engine of the type described which incorporates optimum solutions to the problems discussed above in order to achieve a practicable, workable, and highly efficient engine that is competitive to well-established reciprocating piston engines both with respect to economy of operation and environmental pollution impact.

These and other objects of the present invention will become more apparent after consideration of the following detailed specifications taken in conjunction with the accompanying drawings wherein like characters of reference designate like parts throughout the several views.

FIGURE DESCRIPTION

DETAILED DESCRIPTION OF THE DISCLOSURE

Figure 8:
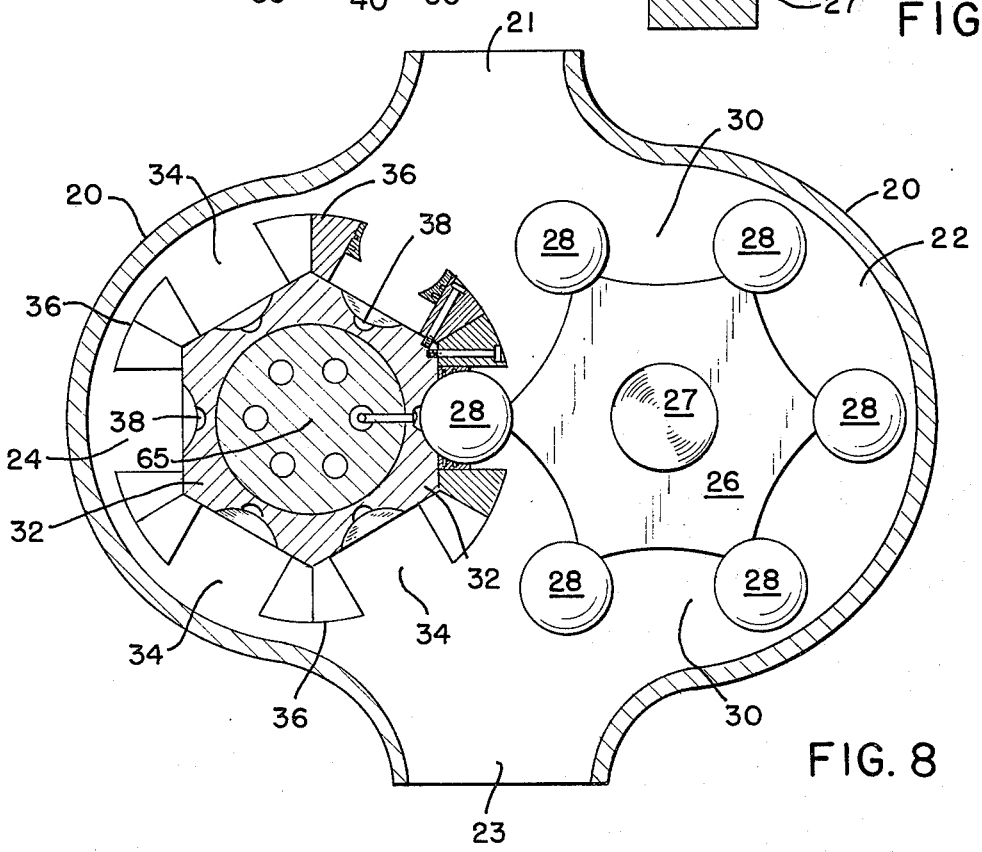
FIG. 8 is a side elevational sectional view of the cooperating rotor and sealing member illustrating the operation of the fuel injection assembly and slidable sealing assembly.

Referring now to the drawings and particularly to FIG. 8, a casing 20 has two internally formed intersecting cylindrical chambers 22 and 24 comprising working spaces for, in chamber 22, a rotor 26 having a drive shaft 27 and a plurality of radially extending lobes 28 and interspaces 30, and in chamber 24, a rotary sealing member 32, having a plurality of radially extending grooves 34 and dividers 36, the lobes and interspaces 28 and 30 of rotor 26 intermeshing with the grooves and dividers 34 and 36 of the rotary sealing member 32. Each groove 34 has a substantially centered recess 38 extending longitudinally thereof, which will be more particularly and functionally described subsequently.

Figure 7:
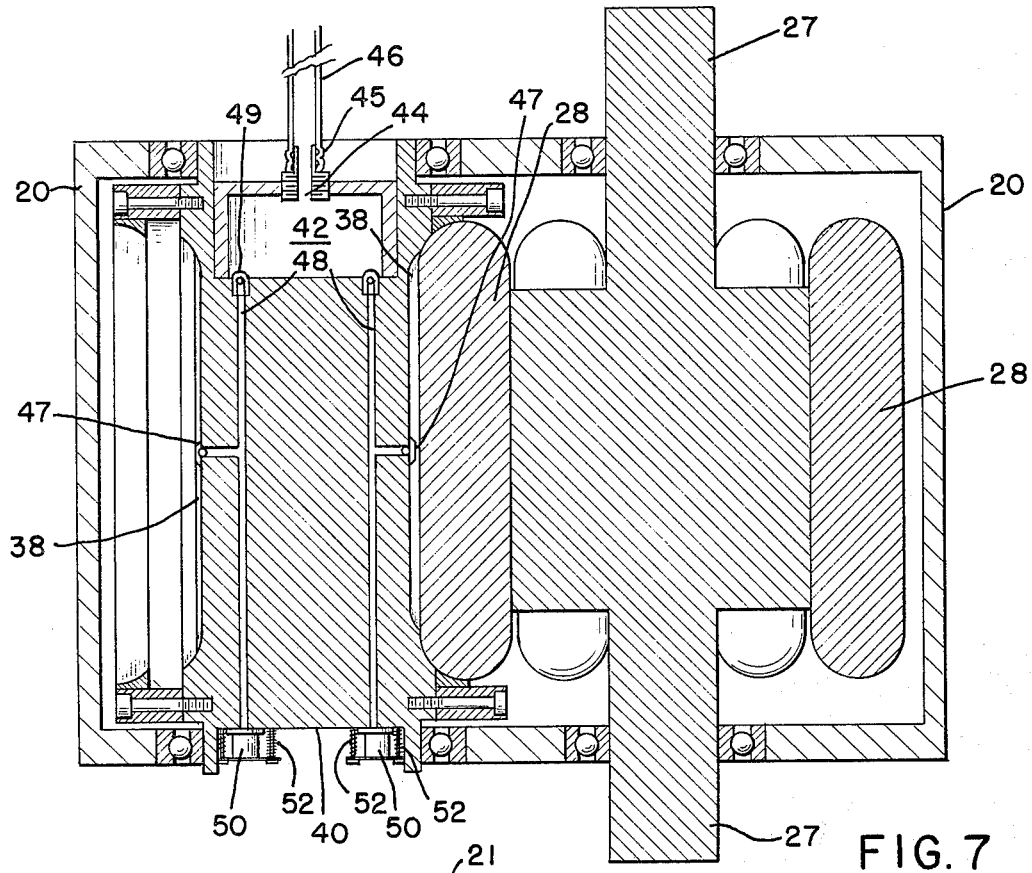
FIG. 7 is a plan sectional view of the cooperating rotor and sealing member and the operation therewith of the fuel injection assembly.

A fuel injection assembly shown generally as 40 (FIG. 7) is cooperatively associated with the rotary sealing member 32 and has a manifold 42, a fuel entry port 44 connecting with the manifold, a supply line 46, and a rotating connector 45 for furnishing fuel at low pressure through the port 44 and into the manifold 42. A plurality of fuel injection chambers 48 communicate with manifold 42 and with centered recess 38. A plunger 50 is associated with each fuel injection chamber and functions to meter fuel and build pressure within the chamber sufficient to force the fuel into the centered recess 38 for ultimate combustion. Plunger 50 is biased by appropriate springs 52 so that it is normally held in a retracted or non-combustion position by the biasing effect of the spring until that biasing effect is overcome by some other appropriate means such as that subsequently to be described.

Figure 5:
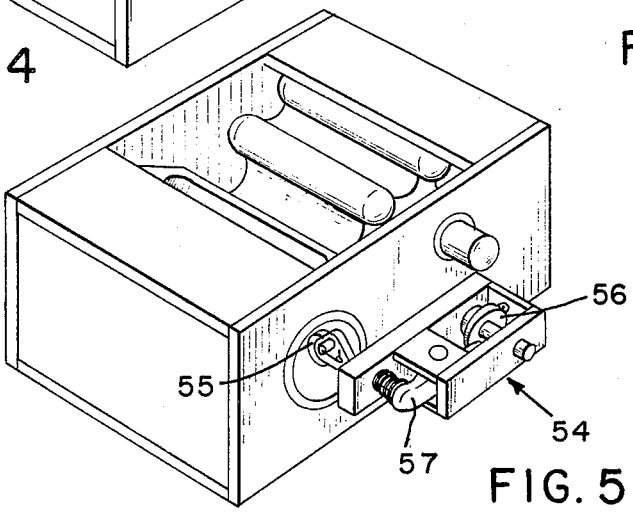
FIG. 5 is a perspective of the casing containing the cooperating rotor and sealing member to which is affixed the fuel control assembly to permit the combustion of fuel and air under pressure within the combustion chambers.

Plunger 50 is actuated by the action of a fuel control assembly shown generally as 54 in FIG. 5 so that only one fuel injection chamber will experience fuel pressures necessary for injection into its respective combustion chamber at any predetermined time, to facilitate a proper combustion cycle. As plunger 50 rides against freewheeling roller 55, it is urged inwardly overcoming the bias of springs 52 and thus forcing fuel under great pressure into centered recess 38 through inlets 47. Inlets 47 are of a design that will permit fuel flow only in one direction and completely seal the port upon combustion in the centered recess 38. Retraction of plunger 50, by bias springs 52, after being activated creates a vacuum in chamber 48 thereby refilling the chamber through check valve 49.

Freewheeling roller 55 is mounted on movable support arm 59 such that when communication occurs with plunger 50 as mover in rotation with rotary sealing member 32, in the proper direction, its rolling action over plunger 50 causes the plunger to be depressed and creates pressure in fuel injection chamber 48 which communicates with inlet 47. Roller 55 is biased in the reverse direction by spring 53. If rotary sealing member 32 should rotate in the opposite direction, communication of roller 55 with plunger 50 will cause an override of bias spring 53, allowing passage of roller 55 over plunger without damage.

A metered amount of fuel is determined by the amount of travel of plunger 50. Movable support arm 59, biased outwardly by spring 71, extends through support block 51 and communicates with rocker arm 57. The communication point of support arm 59 and rocker arm 57 is so designed that rotation of support arm 59 is prohibited. Rocker arm 57, mounted on pin 70, transfers a force determined by point of contact with accelerator cam 56 to support arm 59. The rotational position of cam 56 through the interconnection of rocker arm 57 and support arm 59 determines the position of roller 55 which in turn determines the depth to which plunger 50 will be depressed.

Cam 56, whose normal movement is rotational, one direction for acceleration, the opposite for deceleration, is positioned vertically by wedge shaped block 58. Block 58, when in a normal operating position, forces cam 56 to communicate with rocker arm 57 such that the desired force may be applied to the rocker arm. When block 58 is withdrawn from its normal operating position and contact is removed from cam 56, cam 56 is allowed to part from rocker arm. At this time fuel injection ceases and the engine stops. Fuel control assembly 54 is mounted on casing 20 in a manner allowing specific adjustment whereby precise timing of fuel injection may be accomplished.

Figure 2:
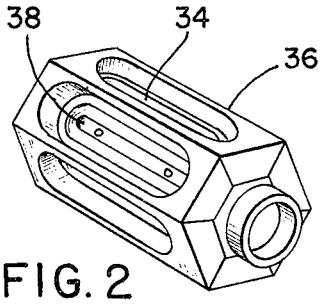
FIG. 2 is a perspective view of the rotary sealing member illustrating the radially extending intercepting grooves and dividers, each of the grooves carrying a centered recess therein.
Figure 1:
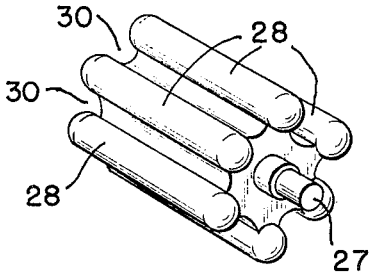
FIG. 1 is a perspective view of the rotor showing the radially extending alternating lobes and interspaces incorporated therewith.
Figure 9:
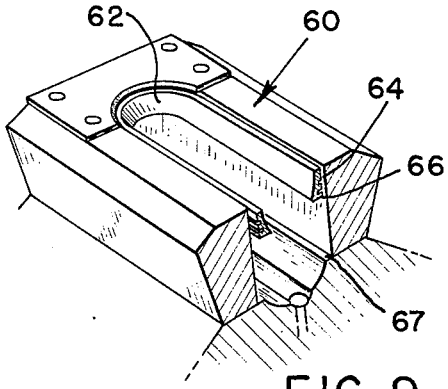
FIG. 9 is a perspective, enlarged, and sectional view of the radially slidable sealing assembly.
Figure 3:
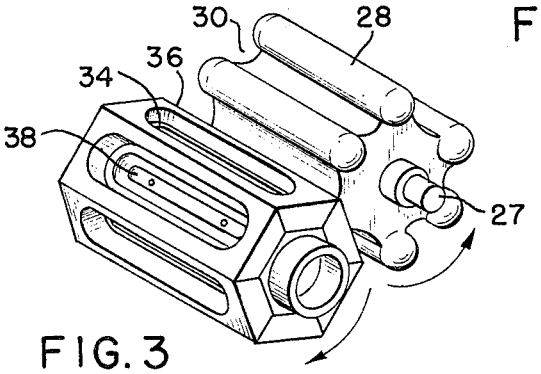
FIG. 3 is a perspective view of cooperative relationship between the rotor and the rotary sealing member illustrated in FIGS. 1 and 2.

Each of the axially extending grooves 34 has a radially slidable sealing assembly shown generally as 60 (FIG. 9) which is radially outwardly biased by appropriate means. An elongated circular integral member 62 carries a plurality of sealing elements 64 on its groove contacting edge 66 to provide a positive seal within each groove as a lobe 28 is cooperatively received therein. Each of the lobes 28 and each of the grooves 34 are cylindrically shaped and end-rounded to intermesh perfectly each with the other and form an exact seal therebetween when associated with the slidable sealing assembly 60 discussed above. Member 62 as it reaches its maximum point of travel, just short of contact with surface 67, creates very desirable heavy turbulence by forcing captive air toward centered recess 38.

Manifold 42 of the fuel injection assembly is a substantially cylindrically shaped chamber centrally formed about the axis 65, located on the opposite end from the plungers 50 of the rotary sealing member 32, and encompassing all check-valved intake ports 49. Fuel is introduced from the supply line 46 through rotating connector 45 and inlet port 44 into manifold 42 where it then fills each of the fuel injection chambers 48 as previously described. When the fuel injection chamber is subjected to pressure because of the camming action of member 56 and roller 55 against plunger 50, the fuel is forced, under intense pressure, through inlets 47 into centered recess 38 for combustion. In a properly timed sequence (after a lobe 28 is cooperatively received within a recess 34 and has encapsulated a volume of air), rotation provides compression of air, fuel is injected, and combustion takes place. Upon combustion, the thrust exerted causes the lobe and recess to separate under power and the members move in synchronism to the next combustion position achieved when another lobe 28 is received by a recess 34 and repeats the cycle.

Contrary to a number of earlier designs of rotary internal combustion engines, the present invention contemplates the same number of lobes as grooves. This offers the decided advantage of having the same groove receive the same lobe throughout the entire operation of the engine thus avoiding the attendant wear that can be experienced when this pattern is not followed. When the number of lobes are not equal to the number of recesses, a random cooperation between lobes and grooves will occur.

Figure 10:
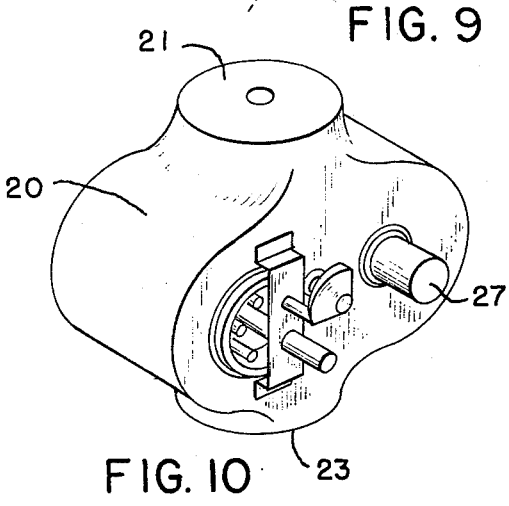
FIG. 10 is a perspective view of the device illustrated in FIGS. 7 and 8 above.
Figure 4:
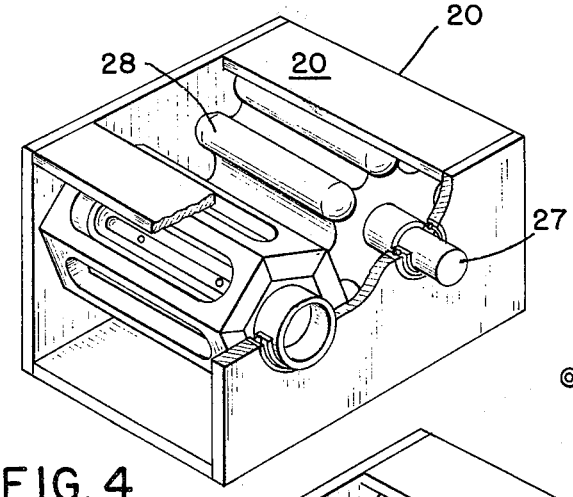
FIG. 4 is a perspective and sectional view of the cooperating rotor and rotary sealing member positioned within a casing.
Figure 6:
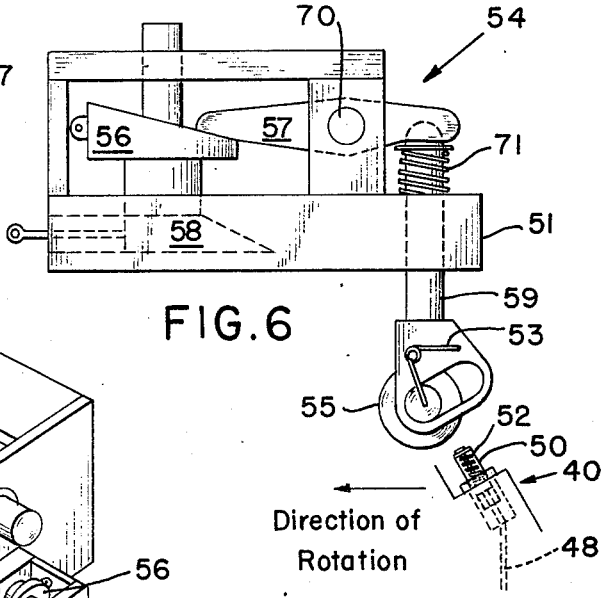
FIG. 6 is a side elevational and sectional view of the fuel control assembly shown in FIG. 5.

Fresh air intake 21 and exhaust port 23 are extended through casing 20 to permit the removal of exhaust fumes formed from the combustion cycle. A commercially aesthetic embodiment of the present invention is shown perspectively in FIG. 10 whereby casing 20 is designed to produce savings in material. Air intake 21 may also incorporate a blower to insure movement of sufficient fresh air in and exhaust gases out of the engine. This embodiment contains the features described in detail above and presents the drive shaft 27 connected directly to the rotor for ultimate connection to a gear-drive wheel mechanism as a prime mover.

No exact or relative dimensions of the mechanical parts of the various elements of the present invention or the capacities of the chambers and other elements have been shown herein, it being obvious that the drawings are merely illustrative of the invention. Various changes in construction and design of the respective parts can be made without departing from the spirit or scope of the invention which is defined solely by the appended claims.

I claim:

1. A rotary diesel engine comprising: a casing providing a working space forming at least two intersecting cylindrical chambers; a rotor rotatably positioned in at least one of said chambers having a plurality of radially extending and alternating lobes and interspaces; a rotary sealing member positioned in at least one of the other of said chambers having a plurality of radially extending and alternating grooves and dividers intermeshing with the lobes and interspaces of said rotor, each groove having a substantially centered longitudinally extending recess therein; a fuel injection assembly cooperatively carried by said rotary sealing member having a manifold, a fuel entry port connecting with said manifold, means controlling the quantity of fuel introduced through said entry port, a plurality of fuel injection chambers communicating with said manifold and said substantially centered recess, pressure building means proximate each of said fuel injection chambers operable to force fuel under pressure into said substantially centered recess for combustion, and means selectively actuating said pressure building means and said fuel quantity controlling means; and exhaust means associated with said intersecting cylindrical chambers.

2. The diesel engine as claimed in claim 1 wherein each of said axially extending grooves has a radially slidable sealing assembly and an outwardly biasing means urging said assembly radially outwardly.

3. The diesel engine as claimed in claim 2 wherein said slidable sealing assembly includes a continuous ring movably maintained within each of said grooves.

4. The diesel engine as claimed in claim 3 wherein each of said lobes is generally cylindrical and end-rounded to operatively intermesh with each of said grooves and associated slidable assemblies.

5. The diesel engine as claimed in claim 1 wherein said manifold is substantially cylindrically shaped about the rotating axis of said rotary sealing member.

6. The diesel engine as claimed in claim 4 wherein said manifold is substantially cylindrically shaped about the rotating axis of said rotary sealing member.

7. The diesel engine as claimed in claim 6 wherein said pressure building means includes a plunger associated with each fuel injection chamber and biasing means normally maintaining said plunger proximate said chamber in a non-pressure creating position.

8. The diesel engine as claimed in claim 7 wherein said pressure creating means actuating means and said fuel quantity controlling means includes a fuel control assembly having a movable support arm, a roller selectively actuating said plunger, and camming means controlling the selective displacement of said support arm and said roller as said roller selectively engages each of said plungers.

9. The diesel engine as claimed in claim 8 wherein said exhaust means includes at least one port extending through said casing through which the by-products of combustion may pass.

10. The diesel engine as claimed in claim 1 wherein the number of lobes and interspaces of each rotor is equal to the number of grooves and dividers of each sealing member.

11. The diesel engine as claimed in claim 8 wherein the number of lobes and interspaces of each rotor is equal to the number of grooves and dividers of each sealing member.

12. The diesel engine as claimed in claim 11 wherein said fuel injection chambers align radially and selectively with said groove-carried recesses.

13. The diesel engine as claimed in claim 9 wherein the number of lobes and interspaces of each rotor is equal to the number of grooves and dividers of each sealing member.

14. The diesel engine as claimed in claim 1 wherein said pressure building means includes a plunger associated with each fuel injection chamber and biasing means normally maintaining said plunger proximate said chamber in a non-pressure creating position and wherein said pressure creating means actuating means and said fuel quantity controlling means include a fuel control assembly having a movable support arm, a roller selectively actuating said plungers, and camming means controlling the selective displacement of said support arm and said roller as said roller selectively engages each of said plungers.

15. The diesel engine as claimed in claim 1 wherein each of said axially extending grooves has a radially slidable sealing assembly and an outwardly biasing means of urging said assembly radially outwardly, said pressure building means including a plunger associated with each fuel injection chamber and biasing means normally maintaining said plunger proximate said chamber in a non-pressure creating position, said pressure creating means actuating means and said fuel quantity controlling means including a fuel control assembly having a movable support arm, a roller selectively actuating said plungers, and camming means controlling the selective displacement of said support arm and said roller as said roller selectively engages each of said plungers.

* * * * *